US011813657B2

(12) United States Patent
Ross

(10) Patent No.: US 11,813,657 B2
(45) **Date of Patent: *Nov. 14, 2023**

(54) METHOD AND APPARATUS FOR SEALING A METALLIC CONTAINER WITH A METALLIC END CLOSURE

(71) Applicant: BALL CORPORATION, Westminster, CO (US)

(72) Inventor: John R. Ross, Broomfield, CO (US)

(73) Assignee: BALL CORPORATION, Westminster, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/864,830

(22) Filed: Jul. 14, 2022

(65) Prior Publication Data

US 2022/0347736 A1 Nov. 3, 2022

Related U.S. Application Data

(63) Continuation of application No. 16/906,772, filed on Jun. 19, 2020, now Pat. No. 11,446,730.
(Continued)

(51) Int. Cl.
*B21D 51/26* (2006.01)
*B21D 51/46* (2006.01)
(Continued)

(52) U.S. Cl.
CPC ..... *B21D 51/46* (2013.01); *B21D 51/2615* (2013.01); *B21D 51/2661* (2013.01); *B21D 51/48* (2013.01); *B65D 41/125* (2013.01)

(58) Field of Classification Search
CPC ..... B65D 1/0246; B65D 41/125; B65D 43/0233; B65D 2543/00092;
(Continued)

(56) References Cited

U.S. PATENT DOCUMENTS 1,602,126 A 5/1923 Russell
2,026,304 A 12/1935 Florentine
(Continued)

FOREIGN PATENT DOCUMENTS

CA 2665477 5/2008
DE 2644387 4/1978
(Continued)

OTHER PUBLICATIONS

"Screw thread," retrieved from http://en.wikipedia.org/wii/Screw_thread, retrieved on Jan. 8, 2015, 17 pages.
(Continued)

*Primary Examiner* — Jimmy T Nguyen
(74) *Attorney, Agent, or Firm* — Sheridan Ross P.C.

(57) ABSTRACT

An apparatus includes a tool operable to releasably join a metallic end closure to a metallic container. In one embodiment, the tool is configured to form a thread in the closure and the container. The tool may optionally crimp the closure to the container. Once sealed, the container can be opened by rotating the closure in an opening direction. The closure can subsequently re-close the container by rotating the closure in a closing direction.

17 Claims, 9 Drawing Sheets

Related U.S. Application Data

(60) Provisional application No. 62/866,966, filed on Jun. 26, 2019.

(51) Int. Cl.
*B21D 51/48* (2006.01)
*B65D 41/12* (2006.01)

(58) Field of Classification Search
CPC ..... B65D 2543/00277; B65D 2543/00509; B65D 2543/00537; B65D 2543/00555; B65D 2543/00481; B65D 2543/00574; B65D 2543/00972; B21D 51/46; B21D 51/48; B21D 51/50; B21D 51/2615; B21D 51/2661; B21D 51/2653
See application file for complete search history.

(56) References Cited

U.S. PATENT DOCUMENTS

| | | | |
|---|---|---|---|
| 2,038,524 | A | 4/1936 | Carvalho |
| 2,117,407 | A | 1/1937 | Davis |
| 2,102,666 | A | 12/1937 | Annen |
| 2,207,564 | A | 7/1940 | Wackman |
| 2,337,456 | A | 12/1943 | Draper |
| 2,505,641 | A | 4/1950 | Howe |
| 2,559,658 | A | 7/1951 | Pottle |
| 2,661,862 | A | 12/1953 | Howe |
| 2,769,293 | A | 11/1956 | Cox |
| 3,142,280 | A | 7/1964 | William |
| 3,452,897 | A | 7/1969 | Anthony |
| 3,550,832 | A | 12/1970 | Fitzgerald |
| 3,811,174 | A | 5/1974 | Eichinger |
| 3,812,646 | A | 5/1974 | Baldyga et al. |
| 3,817,420 | A | 6/1974 | Heisler |
| 3,979,015 | A | 9/1976 | Arfert |
| 4,007,851 | A | 2/1977 | Walker |
| 4,054,229 | A | 10/1977 | Arfert |
| 4,189,824 | A | 2/1980 | Dillon et al. |
| 4,221,105 | A | 9/1980 | Guest |
| 4,333,584 | A | 6/1982 | Gall |
| 4,823,537 | A | 4/1989 | Duke |
| 4,880,131 | A | 11/1989 | Gallagher et al. |
| 5,016,775 | A | 5/1991 | Buedenbender |
| 5,078,290 | A | 1/1992 | Ochs |
| 5,138,858 | A | 8/1992 | Johnson et al. |
| 5,207,341 | A | 5/1993 | Yeager |
| 5,240,138 | A | 8/1993 | Gallagher |
| 5,293,765 | A | 3/1994 | Nussbaum-Pogacnik |
| 5,704,240 | A | 1/1998 | Jordan |
| 5,718,352 | A | 2/1998 | Diekhoff et al. |
| 5,755,130 | A | 5/1998 | Tung et al. |
| 5,785,198 | A | 7/1998 | Credle, Jr. |
| 5,806,707 | A | 9/1998 | Boehm et al. |
| 5,822,843 | A | 10/1998 | Diekhoff et al. |
| 5,875,906 | A | 3/1999 | Price et al. |
| 6,010,026 | A | 1/2000 | Diekhoff et al. |
| 6,010,028 | A | 1/2000 | Jordan et al. |
| 6,102,225 | A | 8/2000 | Lynn |
| 6,123,212 | A | 9/2000 | Russell et al. |
| 6,206,222 | B1 | 3/2001 | Cudzik |
| 6,301,766 | B1 | 10/2001 | Kollé |
| 6,626,310 | B2 | 9/2003 | Taha |
| 6,959,830 | B1 | 11/2005 | Kanou et al. |
| 6,981,601 | B2 | 1/2006 | Laveault et al. |
| 7,147,123 | B2 | 12/2006 | Yamashita |
| 7,171,840 | B2 | 2/2007 | Kanou et al. |
| 7,555,927 | B2 | 7/2009 | Hanafusa et al. |
| 7,798,357 | B2 | 9/2010 | Hanafusa et al. |
| 7,824,750 | B2 | 11/2010 | Takegoshi et al. |
| 7,905,130 | B2 | 3/2011 | Marshall et al. |
| 7,942,028 | B2 | 5/2011 | Gillest et al. |
| 8,016,148 | B2 | 9/2011 | Walsh |
| 8,037,728 | B2 | 10/2011 | Hosoi |
| 8,037,734 | B2 | 10/2011 | Hanafusa et al. |
| 8,091,402 | B2 | 1/2012 | Hanafusa et al. |
| 8,132,439 | B2 | 3/2012 | Hanafusa et al. |
| 8,356,722 | B2 | 1/2013 | Dubs et al. |
| 8,360,266 | B2 | 1/2013 | Adams et al. |
| 8,474,634 | B1 | 7/2013 | Branson et al. |
| 8,496,131 | B2 | 7/2013 | Forrest et al. |
| 8,505,350 | B2 | 8/2013 | Marshall et al. |
| 8,613,369 | B2 | 12/2013 | Kitto |
| 8,740,001 | B2 | 6/2014 | Hanafusa et al. |
| 9,073,113 | B2 | 7/2015 | Nishimoto |
| 9,227,748 | B2 | 1/2016 | Nakagawa et al. |
| 9,265,287 | B2 | 2/2016 | Sims et al. |
| 9,617,043 | B2 | 4/2017 | McGirr et al. |
| 9,821,926 | B2 | 11/2017 | Robinson et al. |
| 9,868,564 | B2 | 1/2018 | McGirr et al. |
| 10,040,593 | B2 | 8/2018 | Ross et al. |
| 11,130,606 | B2 | 9/2021 | Ross et al. |
| 11,446,730 | B2 * | 9/2022 | Ross ..... B21D 51/48 |
| 2005/0008458 | A1 | 1/2005 | Keech et al. |
| 2005/0039416 | A1 | 2/2005 | Hidding |
| 2005/0067365 | A1 | 3/2005 | Hanafusa et al. |
| 2005/0115294 | A1 | 6/2005 | Kanou et al. |
| 2007/0017089 | A1 | 1/2007 | Hosoi |
| 2007/0062952 | A1 | 3/2007 | Kobayashi et al. |
| 2008/0011702 | A1 | 1/2008 | Walsh |
| 2008/0017642 | A1 | 1/2008 | King |
| 2008/0047922 | A1 | 2/2008 | Olson et al. |
| 2010/0051576 | A1 | 3/2010 | Tran et al. |
| 2010/0065528 | A1 | 3/2010 | Hanafusa et al. |
| 2010/0326946 | A1 | 12/2010 | Hanafusa et al. |
| 2011/0164948 | A1 | 7/2011 | Marshall et al. |
| 2012/0031913 | A1 | 2/2012 | Moore et al. |
| 2012/0269602 | A1 | 10/2012 | Hanafusa et al. |
| 2013/0199017 | A1 | 8/2013 | Kurosawa et al. |
| 2014/0116979 | A1 | 5/2014 | Dunwoody |
| 2014/0298641 | A1 * | 10/2014 | Siles ..... B65D 1/0207 29/527.5 |
| 2015/0013416 | A1 * | 1/2015 | Hosoi ..... B21D 51/38 72/68 |
| 2016/0340088 | A1 | 11/2016 | Olson et al. |
| 2017/0073110 | A1 | 3/2017 | Campbell |
| 2017/0267415 | A1 | 9/2017 | Olson et al. |
| 2018/0044155 | A1 | 2/2018 | Ross et al. |
| 2018/0134460 | A1 | 5/2018 | Ramsey |
| 2019/0084728 | A1 | 3/2019 | Bonfoey et al. |
| 2020/0156139 | A1 | 5/2020 | Ross et al. |
| 2022/0009668 | A1 | 1/2022 | Ross et al. |

FOREIGN PATENT DOCUMENTS

| | | | |
|---|---|---|---|
| DE | 3505426 | 3/1986 | |
| DE | 20201342 | 5/2002 | |
| EP | 0740971 | 11/1996 | |
| EP | 806345 A1 * | 11/1997 | ..... B21D 51/2661 |
| EP | 2662296 | 11/2013 | |
| EP | 2692657 | 2/2014 | |
| EP | 2835188 | 2/2015 | |
| EP | 2955131 | 12/2015 | |
| GB | 714973 | 9/1954 | |
| HU | 229285 | 10/2013 | |
| JP | S44-25510 | 10/1969 | |
| JP | S51-28374 | 3/1976 | |
| JP | S51 -73557 | 6/1976 | |
| JP | S52-99181 | 8/1977 | |
| JP | S63-123606 | 5/1988 | |
| JP | H02-180159 | 7/1990 | |
| JP | 3025724 | 6/1996 | |
| JP | 2002-137032 | 5/2002 | |
| JP | 2002-302137 | 10/2002 | |
| JP | 2003-205924 | 7/2003 | |
| JP | 2004-210403 | 7/2004 | |
| JP | 2005-96843 | 4/2005 | |
| JP | 3665002 | 6/2005 | |
| JP | 2005-263230 | 9/2005 | |
| JP | 2005-280768 | 10/2005 | |
| JP | 4115133 | 7/2008 | |
| JP | 4159956 | 10/2008 | |
| JP | 4173388 | 10/2008 | |
| JP | 2008-279510 | 11/2008 | |

(56) References Cited

FOREIGN PATENT DOCUMENTS

| | | |
|---|---|---|
| JP | 2009-46189 | 3/2009 |
| JP | 2010-036986 | 2/2010 |
| JP | 2011-505302 | 2/2011 |
| JP | 2011-116456 | 6/2011 |
| JP | 4723762 | 7/2011 |
| JP | 2012-192984 | 10/2012 |
| JP | 5290569 | 9/2013 |
| JP | 5323757 | 10/2013 |
| JP | 2013-244996 | 12/2013 |
| JP | 5597333 | 10/2014 |
| JP | 5855233 | 2/2016 |
| JP | 5887340 | 3/2016 |
| RU | 2326033 | 6/2008 |
| RU | 2522059 | 7/2014 |
| RU | 2642231 | 1/2018 |
| WO | WO 94/20237 | 9/1994 |
| WO | WO 99/32363 | 7/1999 |
| WO | WO 00/50311 | 8/2000 |
| WO | WO 2009/134132 | 11/2009 |
| WO | WO 2010/117009 | 10/2010 |
| WO | WO 2011/078057 | 6/2011 |
| WO | WO 2012/133391 | 10/2012 |
| WO | WO 2012/143322 | 10/2012 |
| WO | WO 2012/144490 | 10/2012 |
| WO | WO 2013/167478 | 11/2013 |
| WO | WO 2013/167483 | 11/2013 |
| WO | WO 2016/166112 | 10/2016 |

OTHER PUBLICATIONS

"Electromagnetic forming," retrieved from http://en.wikipedia.org/wiki/Electromagnetic_forming, retrieved on Nov. 17, 2014, 4 pages.

International Search Report and Written Opinion for International (PCT) Patent Application No. PCT/US2020/038640, dated Sep. 8, 2020 9 pages.

International Preliminary Report on Patentability for International (PCT) Patent Application No. PT/US2020/038640, dated Jan. 6, 2022 6 pages.

Extended European Search Report for European Patent Application No. 20831400.5, dated Jun. 26, 2023, 10 pages.

* cited by examiner

METHOD AND APPARATUS FOR SEALING A METALLIC CONTAINER WITH A METALLIC END CLOSURE

CROSS-REFERENCE TO RELATED APPLICATIONS

This application is a continuation application of U.S. patent application Ser. No. 16/906,772, filed Jun. 19, 2020, which claims priority under 35 U.S.C. § 119(e) to U.S. Provisional Patent Application Ser. No. 62/866,966 filed Jun. 26, 2019, which are both incorporated herein in their entirety by reference.

FIELD

The present disclosure relates generally to an apparatus and method of sealing metallic containers. More specifically, an apparatus and method are disclosed to releasably join a metallic end closure to a metallic container. In one embodiment, the apparatus is configured to form a thread in the metallic container and the metallic end closure.

BACKGROUND

Metallic containers provide many benefits compared to containers made of glass or plastic. Metallic containers offer an impermeable barrier to light, water vapor, oils and fats, oxygen, and micro-organisms and keep the contents of the metallic container fresh and protected from external influences, thereby guaranteeing a long shelf-life.

The increased durability of metallic containers compared to glass containers reduces the number of containers damaged during processing and shipping, resulting in further savings. The light-weight of metallic containers results in energy savings during shipment. Finally, recycling metallic containers is easier because labels and other indicia are printed directly onto the metallic containers while glass and plastic bottles typically have labels that must be separated during the recycling process. Because of these and other benefits, many consumers and distributors prefer metallic containers.

Some metallic containers are sealed with end closures that are seamed to the metallic containers. A tool is generally required to open metallic containers sealed by a seamed-on end closure. The use of a tool to open the metallic containers is inconvenient and makes the metallic containers difficult to open. Further, once an end closure is cut with the tool, the metallic container cannot be reclosed with the end closure.

Some seamed-on end closures are known that include scores that form a tear panel. An opening is formed through an end closure by pulling on a tab to release the tear panel. However, some consumers have difficulty pulling a tab with sufficient force to open the tear panel, especially for full-aperture tear panels. Also, when opened, the tear panel and the scores typically leave sharp metal edges that may cut a consumer. The metallic container also cannot be reclosed with the seamed-on end closure after the tear panel is separated from the end closure. Another disadvantage is that the end closure must be formed of a thicker material to prevent inadvertent rupture of the scores.

Other metallic containers include threads that engage a threaded closure, such as a roll-on pilfer proof (ROPP) closure. However, the threaded portion of the metallic container must generally be thicker than other parts of the metallic container which requires the use of more metallic material increasing the cost of the metallic container. Further, the container threads must be strong enough to resist the force of the capping apparatus as it forms threads on the ROPP closure with a thread roller. The thread roller presses against an exterior of the ROPP closure and winds around the ROPP closure while using the underlying container threads as a mandrel to form the closure threads. If the thread roller is not properly calibrated or malfunctions, the sideload applied by the thread roller can damage the metallic container. The capping apparatus also has many components that are subject to wear and require frequent service or calibration.

Due to these and other limitations of known methods and apparatus of sealing metallic containers, there is a need for and apparatus and method that can seal a metallic container used to store foodstuffs and other products with a twist off metallic end closure without damaging the metallic container and such that the metallic end closure can selectively reclose the metallic container.

SUMMARY

One aspect of the present disclosure is a novel metallic container sealed with a metallic end closure. The metallic end closure is positioned in an opening of the metallic container. After the metallic end closure is positioned in the container opening a thread is simultaneously formed on both the metallic container and the metallic end closure.

Another aspect of the present disclosure is an apparatus and method of sealing a metallic container with a metallic end closure after the metallic container is filled with a product. In one embodiment, the metallic end closure can be joined to the metallic container by a joining tool. The joining tool can apply a compressive force to the metallic end closure and the metallic container to releasably seal the metallic container. Optionally, the metallic end closure is crimped to the metallic container.

In one embodiment, the joining tool can form a thread on the metallic end closure and the metallic container. The thread can be a partial helical thread that extends up to approximately ¼, or up to approximately ½ around the circumference of the metallic end closure.

The apparatus and method of the present disclosure provide many benefits. For example, the metallic end closure can be selectively removed from the metallic container. No tools are required to remove the metallic end closure from the metallic container. A consumer can remove the metallic end closure by rotating the metallic end closure relative to the metallic container. In one embodiment, the metallic container can be opened by rotating the metallic end closure less than 180°, or less than approximately 90°. After opening the metallic container, there are no cut or sharp edges on either the metallic end closure or the metallic container.

The metallic end closure can subsequently be used to reclose or reseal the metallic container. For example, the metallic end closure can be positioned in an opening of the metallic container and then rotated in a closing direction to close or seal the metallic container.

In one embodiment, a metallic container sealed with a metallic end closure of the present disclosure can be used to store a product that does not have a high pressure requirement. The product can be dried goods such as coffee beans, snacks, chips, nuts, powders, or other products. Liquids can also be stored in the metallic container.

The metallic end closure can be formed of thinner material than a typical end closure for a two-piece beverage container. For example, the metallic end closure can be less than approximately 0.015 inch thick, or less than approximately 0.010 inch thick. In one embodiment, the metallic end closure has a thickness of between approximately 0.005 inches and approximately 0.02 inches. Similarly, an upper portion or neck of the metallic container does not require thicker material to form threads or to resist damage caused by thread roller such as for a metallic bottle sealed by a ROPP closure. In one embodiment, the metallic container has a sidewall with a thickness that is substantially uniform from a closed endwall to an upper opening.

Additionally, the capping apparatus can have fewer parts and apply less force to the metallic end closure and the metallic container. The capping apparatus may also require less service and maintenance than capping apparatus used to seal threaded beverage bottles made of metal. Accordingly, the sealing apparatus of the present disclosure reduces operating costs and decreases the number of containers damaged during sealing.

One aspect of the present disclosure is to provide an apparatus to seal a metallic container with a metallic end closure. The apparatus generally comprises: (1) a first tool to receive the metallic container filled with a product and with the metallic end closure positioned in the opening of the metallic container, the metallic container including: (a) a closed bottom end; (b) a sidewall extending upwardly from the closed bottom end; and (c) a container curl extending from an upper end of the sidewall to define an opening; and the metallic end closure including: (i) a central panel; (ii) an inner panel wall extending upwardly from the central panel; (iii) a countersink extending outwardly from the inner panel wall and forming an uppermost portion of the metallic end closure; and (iv) an outer panel wall extending downwardly from the countersink, the outer panel wall being oriented substantially parallel to the container sidewall; and (2) a joining tool that applies a compressive force to the metallic container and the metallic end closure to seal the metallic end closure to the metallic container such that the joining tool forms a thread by bending a portion of the inner and outer panel walls of the metallic end closure and the container sidewall outwardly or inwardly. In this manner, the metallic end closure is releasably connected to the metallic container by the apparatus. Before the joining tool forms the thread the outer panel wall of the metallic end closure and the container sidewall can be approximately parallel to a longitudinal axis of the metallic container.

In one embodiment, the container curl extends outwardly away from an interior of the metallic container. Alternatively, the container curl extends inwardly into the metallic container interior.

Optionally, the container sidewall has a diameter that is substantially constant from the closed bottom end to the opening. In one embodiment, the metallic container has a shape that is generally cylindrical. Alternatively, in another embodiment, a cross-section of the metallic container that is perpendicular to the longitudinal axis has a shape that is not circular. For example, the cross-sectional shape of the metallic container can be an oval, a square, or a rectangle. In one embodiment, at least a portion of the sidewall is not parallel to the longitudinal axis. The metallic container may include a shoulder. Optionally, the metallic container can include a neck with a decreased diameter.

In one embodiment, the joining tool compresses the container sidewall between the inner and outer panel walls of the metallic end closure to form the thread. The joining tool can be configured to form a thread which has a helical length. In one embodiment, the thread formed by the joining tool extends up to approximately 540° around the metallic end closure. For example, in one embodiment, the thread has a helical length of between approximately 45° and approximately 540°. In another embodiment, the thread extends between approximately 75° and approximately 120°. Optionally, the joining tool is configured to form a thread that extends up to approximately one-fourth of a circumference of the metallic end closure. In one embodiment, the thread formed by the joining tool extends between approximately 75° and 90° around the circumference of the metallic end closure.

Optionally, in another embodiment, the apparatus forms four threads. In one embodiment, each thread extends less than 90° around the circumference of the metallic end closure. In this manner an uppermost portion of a first thread can be offset by a predetermined arc length from a lowermost portion of a second thread that is adjacent to the first thread. More specifically, portions of the inner and outer panel walls between the uppermost portion of the first thread and the lowermost portion of the second thread can be unbent by the joining tool.

The thread formed by the joining tool comprises an inner closure thread portion on the inner panel wall of the metallic end closure, a container thread portion on the container sidewall, and an outer closure thread portion on the outer panel wall of the metallic end closure. The container thread portion extends through the container curl.

The container thread portion has a helical length that is approximately equal to a helical length of the inner closure thread portion.

Optionally, the outer closure thread portion has a helical length that is approximately equal to the helical length of the inner closure thread portion.

In one embodiment, the outer closure thread portion extends through a closure peripheral curl extending from (or positioned at) a lowermost portion of the outer panel wall.

Optionally, the inner closure thread portion extends downwardly below the closure peripheral curl. In one embodiment, the helical length of the outer closure thread portion is less than the helical length of the inner closure thread portion.

In one embodiment, the joining tool is adapted to form the thread from the countersink of the metallic end closure and downward past a lowermost portion of the outer panel wall. In this manner, between the countersink and the lowermost portion of the outer panel wall, the thread comprises the container thread portion positioned between the inner closure thread portion on the inner panel wall and the outer closure thread portion on the outer panel wall.

Below the lowermost portion of the outer panel wall, the thread comprises the inner closure thread portion on the inner panel wall and the container thread portion which is not covered by the outer panel wall. More specifically, at least a portion of the helical length of the container thread portion is not covered by the outer panel wall.

In one embodiment, the joining tool is adapted to form the thread from the countersink of the metallic end closure and to a position above a lowermost portion of the outer panel wall. Accordingly, a lowermost portion of the thread is positioned above the lowermost portion of the outer panel wall.

Optionally, the metallic end closure includes a peripheral curl releasably interconnected to the lowermost portion of the outer panel wall by a score or a perforation. In this manner, the peripheral curl can separate from the outer panel wall when the metallic end closure is rotated in an opening direction.

In one embodiment, the score extends through a lowermost portion of the outer closure thread. For example, the score can contact at least a portion of the outer closure thread.

Optionally, the score extends around the circumference of the metallic end closure above the lowermost portion of the outer closure thread. Specifically, in one embodiment, the score is positioned between the lowermost portion of the outer closure thread and the countersink of the metallic end closure. Accordingly, in some embodiments, the outer closure thread extends through the score.

The apparatus can further include a second tool to apply a top-load to the countersink. In this manner, the second tool can press the metallic end closure against the container curl.

In one embodiment, the joining tool includes an inner tool and an outer tool. The inner tool and the outer tool are operable to move toward each other to compress the container sidewall between the inner panel wall and the outer panel to form the thread.

The inner tool has an outer face. A protrusion projects outwardly from the outer face of the inner tool. The outer face has a convex shape that is approximately congruent to a concave segment of the inner panel wall of the metallic end closure. In one embodiment, the outer face has a radius of curvature that is approximately equal to a radius of curvature of the inner panel wall.

The outer tool has an inner face. A recess extends inwardly into the inner face. The recess is adapted to interlock with the protrusion of the inner tool. More specifically, the recess has a shape that generally corresponds to a shape of the protrusion of the inner tool. In this manner, to form the thread, the recess of the outer tool interlocks with the protrusion of the inner tool to bend the inner and outer panel walls and the container sidewall outwardly.

The inner face has a concave shape that is approximately congruent to a convex segment of the outer panel wall of the metallic end closure. More specifically, in one embodiment the inner face has a radius of curvature approximately equal to a radius of curvature of the outer panel wall.

Alternatively, in another embodiment, the outer face of the inner tool includes a recess extending inwardly into the inner face. The inner face of the outer tool includes a protrusion configured to align with the recess of the inner face. The recess of the inner tool is adapted to interlock with the protrusion of the outer tool. In this embodiment, the recess of the inner tool interlocks with the protrusion of the outer tool to bend the inner and outer panel walls and the container sidewall inwardly to form the thread.

It is another aspect of the present disclosure to provide a method of sealing a metallic container with a selectively removable metallic end closure, comprising: (1) positioning the metallic end closure in an opening of the metallic container that is at least partially filled with a product, the metallic container including: (a) a closed bottom end; (b) a sidewall extending upwardly from the closed bottom end; and (c) a container curl extending from an upper end of the sidewall to define the opening; and the metallic end closure including (i) a central panel; (ii) an inner panel wall extending upwardly from the central panel; (iii) a countersink at an upper end of the inner panel wall and extending outwardly from the inner panel wall; and (iv) an outer panel wall extending downwardly from the countersink and with the outer panel wall oriented substantially parallel to the container sidewall; and (2) applying a compressive force to the metallic container and the metallic end closure with a joining tool to seal the metallic end closure to the metallic container, the joining tool bending the inner and outer panel walls of the metallic end closure and the container sidewall to form a thread. In this manner the metallic end closure is releasably connected to the metallic container. In one embodiment, the container sidewall is approximately parallel to a longitudinal axis of the metallic container.

In one embodiment, the container curl extends outwardly away from an interior of the metallic container. Alternatively, the container curl extends inwardly into the metallic container interior.

The method can further include moving an inner tool of the joining tool outwardly against the inner panel wall. Additionally, or alternatively, the method includes moving an outer tool of the joining tool inwardly against the outer panel wall.

In one embodiment, the inner tool has an outer face with a convex shape and a protrusion projecting outwardly from the outer face. The outer face of the inner tool can be approximately congruent to a concave segment of the inner panel wall of the metallic end closure. Additionally, or alternatively, the outer face can have a radius of curvature that is approximately equal to a radius of curvature of the inner panel wall.

The outer tool can have an inner face with a concave shape and with a recess extending inwardly into the inner face. The recess is configured to align with the protrusion of the inner tool. More specifically, in one embodiment the recess is adapted to interlock with the protrusion of the inner tool when the joining tool forms the thread.

Alternatively, in another embodiment, the outer face of the inner tool includes a recess extending inwardly into the inner face. The inner face of the outer tool includes a protrusion configured to align with the recess of the inner face. Accordingly, in one embodiment, the inner and outer tools of the joining tool form the thread by bending a portion of the inner and outer panel walls of the metallic end closure and the container sidewall inwardly toward a longitudinal axis of the metallic container.

The concave shape of the inner face can be approximately congruent to a convex segment of the outer panel wall of the metallic end closure. In one embodiment, the inner face of the outer tool has a radius of curvature approximately equal to a radius of curvature of the outer panel wall.

In one embodiment, the joining tool is configured to form a thread that extends up to approximately 540° around a circumference of the outer panel wall of the metallic end closure. For example, in one embodiment, the joining tool forms a thread that extends between approximately 45° and approximately 540°. In another embodiment, the thread formed by the joining tool extends between approximately 75° and approximately 120°. Optionally, the joining tool is configured to form a thread that extends up to approximately 90° around the circumference of the metallic end closure.

Optionally, the thread extends through a score formed in the outer panel wall. Accordingly, the joining tool is configured to form the thread without rupturing or severing the score.

Another aspect is to provide a metallic container sealed with a selectively removable metallic end closure. The metallic container generally includes, but is not limited to, one or more of: (1) a container body with a closed bottom end, a sidewall extending upwardly from the closed bottom end, and a container curl extending from an upper end of the sidewall to define an opening; and (2) a metallic end closure sealed in the container opening and including a central panel, an inner panel wall extending upwardly from the central panel, a countersink extending outwardly from the inner panel wall, and an outer panel wall extending downwardly from the countersink. Portions of the inner and outer panel walls and the sidewall are bent away from, or closer to, a longitudinal axis of the metallic container to form a thread that extends through the container curl.

In one embodiment, the container curl extends outwardly away from an interior of the metallic container. Alternatively, the container curl extends inwardly into the metallic container interior.

In one embodiment, the thread extends outwardly away from the longitudinal axis of the metallic container. Alternatively, the thread extends inwardly toward the longitudinal axis.

In one embodiment, the container body has a generally cylindrical shape. Optionally, the sidewall is approximately parallel to the longitudinal axis of the metallic container.

In one embodiment, the inner and outer panel walls are compressed against the container body to form the thread. The thread includes an inner closure thread portion on the inner panel wall of the metallic end closure, a container thread portion on the container sidewall, and an outer closure thread portion on the outer panel wall of the metallic end closure. The container thread portion extends through the container curl.

The thread has a helical length that extends between approximately 45° and approximately 540° around a circumference of the metallic end closure. Optionally, the thread extends less than one-half of the circumference of the metallic end closure. For example, the thread can extend between approximately 75° and approximately 120°. In one embodiment, the thread has a helical length that is up to approximately one-fourth of the circumference of the metallic end closure.

Optionally, the metallic container can have four threads. In one embodiment, a first thread has an upper end that is spaced from a lower end of a second adjacent thread by an arc of a predetermined length.

In one embodiment, the thread extends downwardly from the countersink of the metallic end closure and downward past a lowermost portion of the outer panel wall. In one embodiment, the thread extends through a peripheral curl extending from or positioned at the lowermost portion of the outer panel wall.

Above the lowermost portion of the outer panel wall the thread comprises the container thread portion positioned between the inner closure thread portion on the inner panel wall and the outer closure thread portion on the outer panel wall. Below the lowermost portion of the outer panel wall the thread comprises the inner closure thread portion on the inner panel wall and the container thread portion which is not covered by the outer panel wall.

Accordingly, in this embodiment, the inner closure thread portion has a helical length that is greater than a helical length of the outer closure thread portion. Further, the container thread portion has a helical length that is greater than the helical length of the outer closure thread portion.

Alternatively, in another embodiment, the thread extends downwardly from the countersink of the metallic end closure and ends above a lowermost portion of the outer panel wall. In this manner, the container thread portion has a helical length that is completely covered by the outer closure thread portion on the outer panel wall. More specifically, the helical length of the inner closure thread portion is approximately equal to the helical length of the outer closure thread portion.

Optionally, the metallic end closure can include a peripheral curl releasably interconnected to the lowermost portion of the outer panel wall by a score or a perforation. In this manner, the score defines a tamper or pilfer indicator. In one embodiment, the outer closure thread portion does not extend to the peripheral curl.

In one embodiment, the score extends through a lowermost portion of the outer closure thread portion. In another embodiment, the score is positioned between the lowermost portion of the outer closure thread portion and the countersink of the metallic end closure. Accordingly, in some embodiments of the present disclosure, the outer closure thread portion extends through a score extending around the outer panel wall of the metallic end closure.

When the metallic end closure is sealed in the container opening, the central panel of the metallic end closure is positioned between the container curl and the closed bottom end of the container body relative to the longitudinal axis.

In another embodiment, when the metallic end closure is sealed in the container opening, the peripheral curl of the metallic end closure is positioned between the central panel of the metallic end closure and the container curl of the container body relative to the longitudinal axis.

The central panel of the metallic end closure is positioned between a lowermost portion of the thread and the closed bottom end of the container body when the metallic end closure is sealed in the container opening.

These and other advantages will be apparent from this disclosure. The above-described embodiments, objectives, and configurations are neither complete nor exhaustive. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more clear from the Detailed Description, particularly when taken together with the drawings.

As will be appreciated, other embodiments are possible using, alone or in combination, one or more of the features set forth above or described below. Further, the Summary is neither intended nor should it be construed as representing the full extent and scope of the present disclosure. As will be appreciated, other embodiments are possible using, alone or in combination, one or more of the features set forth above or described below. For example, it is contemplated that various features and elements shown and/or described with respect to one embodiment may be combined with or substituted for features or elements of other embodiments regardless of whether or not such a combination or substitution is specifically shown or described herein.

Although generally referred to herein as "metallic container," or "container," it should be appreciated that the current disclosure may be used to produce containers or "packages" of any size or shape including, for example, containers with a body through which a horizontal cross section defines a circle, an oval, a square, or a rectangle. Further, containers of the present disclosure can be used to store any product, such as liquids, beverages, dried goods, or other products. The product may be stored at a low pressure within the metallic container. In some embodiments, the products are not stored under pressure within the metallic container.

The terms "metal" or "metallic" as used hereinto refer to any metallic material that may be used to form a container, including without limitation aluminum, steel, tin, and any combination thereof. However, it will be appreciated that the apparatus and method of the present disclosure can be used in various forms and embodiments to decorate containers formed of any material, including paper, plastic, and glass.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, ratios, ranges, and so forth used in the specification and claims are to be understood as being modified in all instances by the term "about" or "approximately". Accordingly, unless otherwise indicated, all numbers expressing quantities, dimensions, conditions, ratios, ranges, and so forth used in the specification and claims can be increased or decreased by approximately 5% to achieve satisfactory results. In addition, all ranges described herein may be reduced to any sub-range or portion of the range, or to any value within the range without deviating from the invention. Additionally, where the meaning of the terms "about" or "approximately" as used herein would not otherwise be apparent to one of ordinary skill in the art, the terms "about" and "approximately" should be interpreted as meaning within plus or minus 5% of the stated value.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and Claims themselves.

BRIEF DESCRIPTION OF THE DRAWINGS

The accompanying drawings, which are incorporated in and constitute a part of the specification, illustrate embodiments of the disclosed apparatus and method and together with the general description of the disclosure given above and the detailed description of the drawings given below, serve to explain the principles of the disclosed system(s) and device(s).

Figure 1:
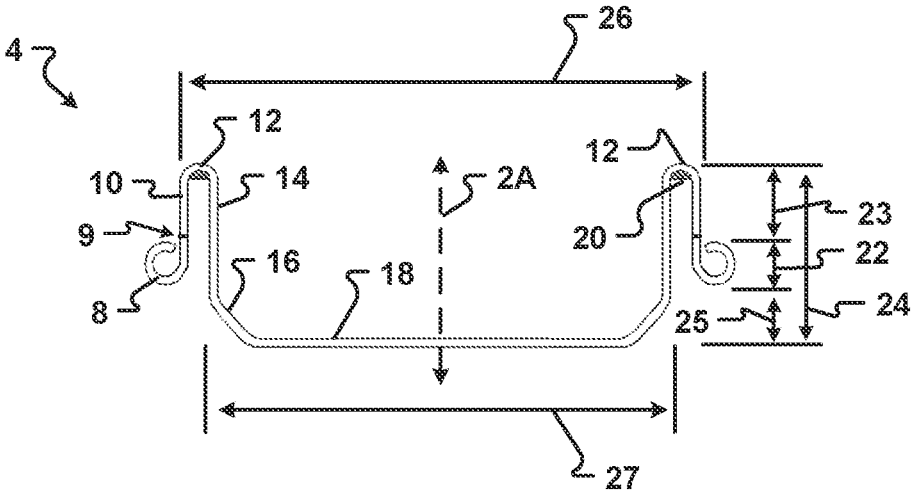
FIG. 1 is a cross-sectional front elevation view of a metallic end closure of one embodiment of the present disclosure.

The drawings are not necessarily (but may be) to scale. In certain instances, details that are not necessary for an understanding of the disclosure or that render other details difficult to perceive may have been omitted. It should be understood, of course, that the disclosure is not necessarily limited to the embodiments illustrated herein. As will be appreciated, other embodiments are possible using, alone or in combination, one or more of the features set forth above or described below. For example, it is contemplated that various features and devices shown and/or described with respect to one embodiment may be combined with or substituted for features or devices of other embodiments regardless of whether or not such a combination or substitution is specifically shown or described herein.

The following is a listing of components according to various embodiments of the present disclosure, and as shown in the drawings:

NUMBER COMPONENT

2 Longitudinal axis
4 Metallic end closure
8 Closure peripheral curl
9 Score or perforation
10 Outer panel wall
12 Countersink
14 Inner panel wall
16 Chuck wall
18 Central panel
20 Sealant
22 Peripheral curl height
23 Distance between peripheral curl and countersink
24 Distance between central panel and countersink
25 Distance between peripheral curl and central panel

26 Closure diameter
27 Inner diameter of the closure
28 Thread
28' First thread
28" Second thread
28'" Third thread
28"" Fourth thread
28A Inner closure thread portion
28B Container thread portion
28C Outer closure thread portion
30 Metallic container
32 Container sidewall
34 Container bottom
35 Inclined wall of bottom
36 Dome
40 Shoulder
42 Container neck (optional)
44 Opening
46 Neck curl
50 Opening direction
52 Closing direction
54 Thread beginning
56 Thread end
58 Arc length between adjacent threads
60 Capping apparatus
62 Support
64 First tool
66 Joining tool
68 Inner joining tool
69 Outer face of inner tool
70 Protrusion of inner joining tool
72 Outer joining tool
73 Inner face of outer tool
74 Recess of outer joining tool
76 Arrow indicating outward motion
78 Arrow indicating inward motion
80 X-axis
82 Y-axis

DETAILED DESCRIPTION

To acquaint persons skilled in the pertinent arts most closely related to the present disclosure, a preferred embodiment that illustrates the best mode now contemplated for putting the invention into practice is described herein by, and with reference to, the annexed drawings that form a part of the specification. Exemplary embodiments are described in detail without attempting to describe all of the various forms and modifications in which the invention might be embodied. As such, the embodiments described herein are illustrative, and as will become apparent to those skilled in the arts, may be modified in numerous ways within the scope and spirit of the disclosure.

Referring now to FIG. 1, a cross-sectional front elevation view of a metallic end closure 4 according to one embodiment of the present disclosure is generally illustrated. The metallic end closure 4 has a body that can optionally include a peripheral curl 8 at a lowermost end of an outer panel wall 10. The peripheral curl 8 can optionally be releasably interconnected to the outer panel wall 10. For example, in one embodiment the peripheral curl 8 is detachably connect to the outer panel wall 10 by a score or perforation 9. In this manner, the peripheral curl 8 defines a portion of a tamper or pilfer band that extends to the score 9.

The outer panel wall 10 can extend upwardly from the peripheral curl 8 to an annular ring or countersink 12 at an uppermost portion of the body. An inner panel wall 14 extends downwardly from the countersink 12. Optionally, a sealant 20 can be positioned between the outer and inner panel walls 10, 14 and proximate to the countersink 12.

A central panel 18 extends inwardly from the inner panel wall 14. The central panel 18 can be approximately perpendicular to a longitudinal axis 2A of the metallic end closure. Optionally, the central panel 18 is interconnected to the inner panel wall 14. In another embodiment, the metallic end closure can include a sloped portion or chuck wall 16 which is positioned between the central panel 18 and the inner panel wall 14. The optional chuck wall 16 is oriented transverse to the longitudinal axis 2A. More specifically, the chuck wall 16 when present is oriented at an obtuse angle to the longitudinal axis and the central panel.

The peripheral curl 8, when present, is configured to prevent a user from contacting a cut outer edge of the metallic end closure. In one embodiment, the peripheral curl 8 generally forms a closed ring. The cut outer edge may be turned back toward the outer panel wall 10. Alternatively, the cut outer edge of the metallic end closure can be turned inwardly toward an interior surface of the outer panel wall to form the peripheral curl 8.

Figure 6:
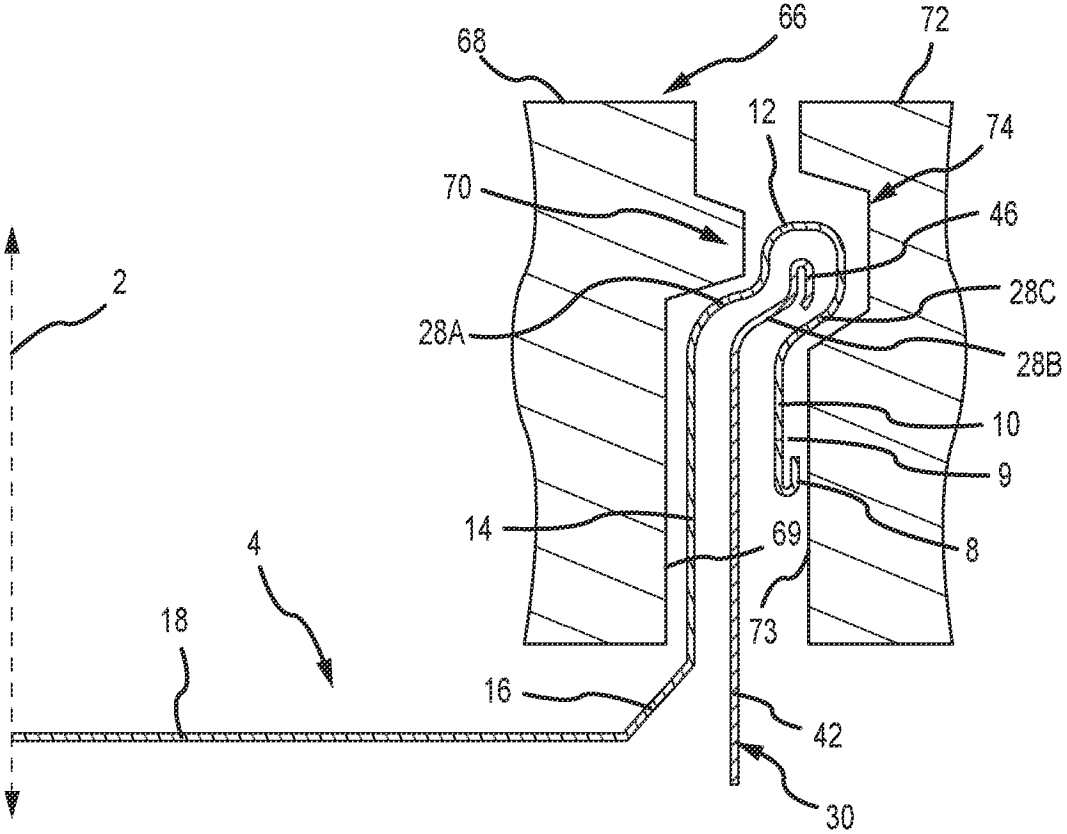
FIG. 6 is a partial cross-sectional front elevation view taken along line 6-6 of FIG. 5 and illustrating joining tools comprising an inner tool applying an outwardly oriented force and an outer tool applying in inwardly oriented force to simultaneously form an upper portion of a thread in the metallic container and the metallic end closure.

The peripheral curl 8 can have a predetermined height 22 or diameter of less than approximately 0.10 inch, or approximately 0.08 inch. Although the peripheral curl 8 is illustrated in FIG. 1 with a generally open or circular cross-section, other configurations are contemplated. For example, the peripheral curl 8 can optionally be generally flattened as shown in FIG. 6, the same as or similar to the container neck curl 46 generally illustrated in FIG. 2. In one embodiment, the peripheral curl 8 includes one, two or more folds of material.

Figure 3:
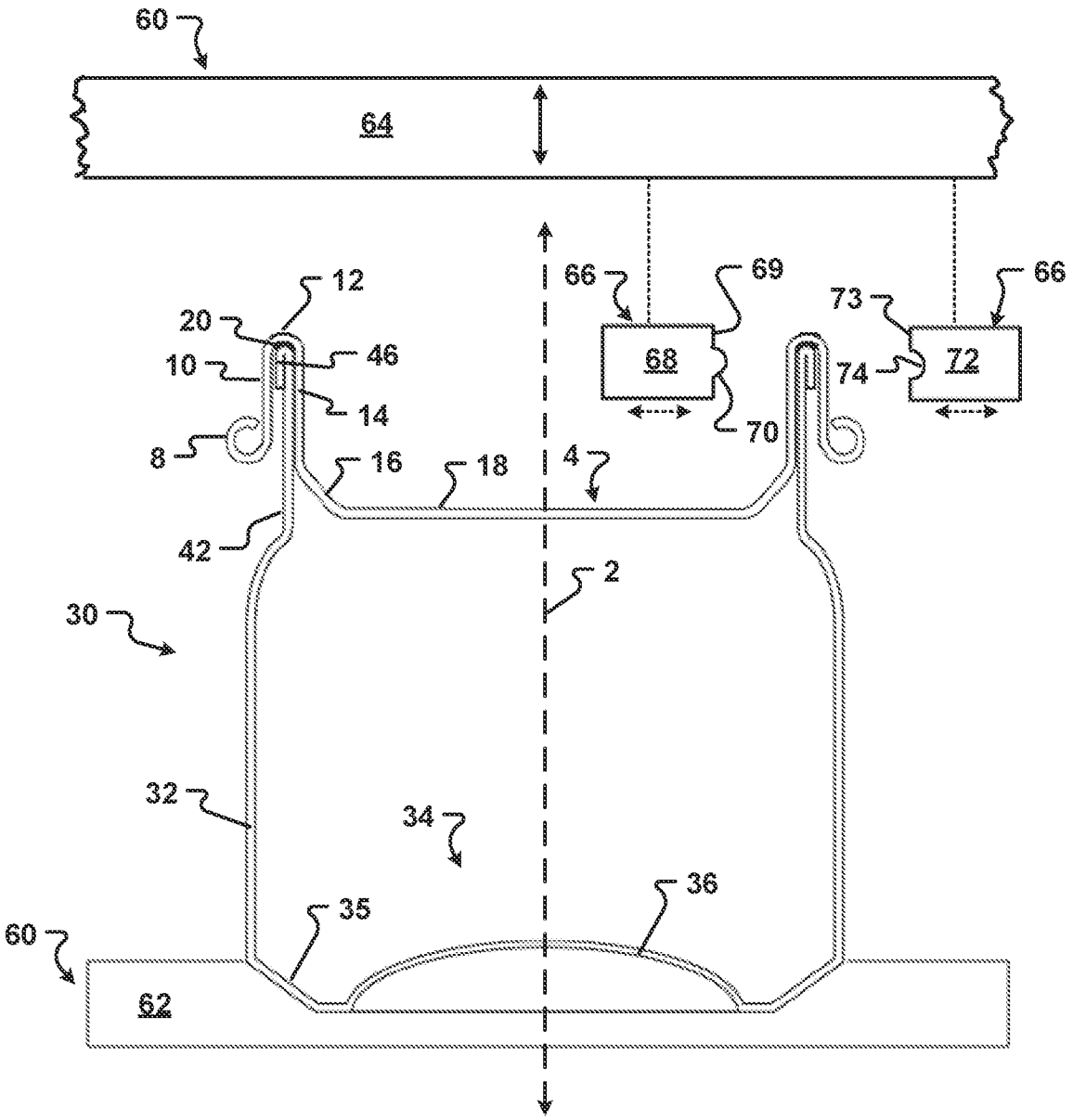
FIG. 3 is a partial cross-sectional front elevation view of the metallic end closure of FIG. 1 positioned on the neck of the metallic container of FIG. 2 before sealing and illustrating tools of a capping apparatus of the present disclosure.

The peripheral curl 8 is positioned a predetermined distance 23 from the countersink 12. In one embodiment, the distance 23 is sufficient to position the optional closure peripheral curl 8 below a container neck curl 46 when the metallic end closure 4 is seated in a metallic container 30 as generally illustrated in FIG. 3.

In one embodiment, the central panel 18 is spaced a predetermined distance 24 from the countersink 12. The distance 24 can be between approximately 0.10 inch and approximately 2 inches. Additionally, or alternatively, the central panel 18 can be spaced a predetermined distance 25 below the lowermost portion of the outer panel wall 10 or the peripheral curl 8.

The outer panel wall 10 defines a diameter 26 of the metallic end closure. The closure diameter 26 can be up to approximately 1.00 inch. In one embodiment, the diameter is up to approximately 1.30 inch. Additionally, or alternatively, the diameter 26 can be between approximately 0.50 inch and approximately 4 inches. The closure diameter 26 is not less than an exterior diameter of a curl 46 of a metallic container 30.

The inner panel wall 14 defines an interior diameter 27 of the metallic end closure. The interior diameter 27 is about equal to, but less than, and interior diameter of an opening 44 of the metallic container.

In one embodiment, the outer and inner panel walls 10, 14 are generally parallel before the metallic end closure is used to seal a metallic container. In another embodiment, the panel walls 10, 14 extend approximately parallel to the longitudinal axis 2A of the metallic end closure 4.

Figure 2:
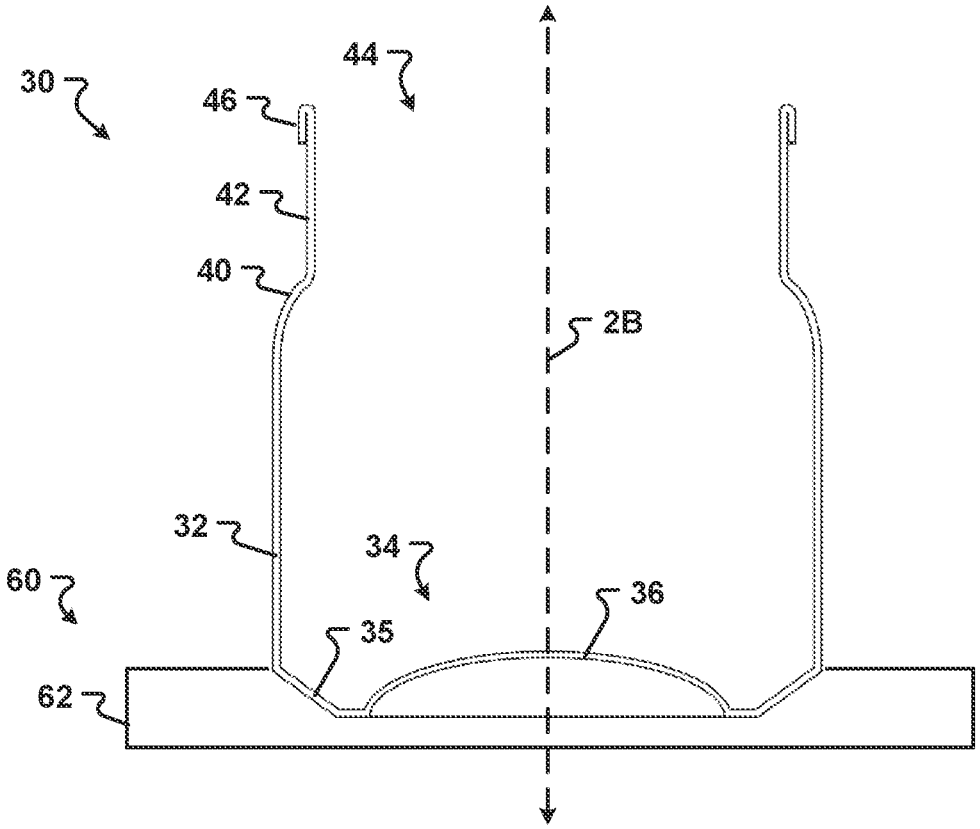
FIG. 2 is a cross-sectional front elevation view of a metallic container of one embodiment of the present disclosure.

Referring now to FIG. 2, a cross-sectional front elevation view of a metallic container 30 according to one embodiment of the present disclosure is illustrated prior to forming threads 28 on the metallic container. The metallic container 30 is shown engaged by a support 62 of a capping apparatus 60 of the present disclosure.

The support 62 can be a chuck or another tool that is operable to one or more of hold and move the metallic container. In one embodiment, the support 62 can position the metallic container in a predetermined orientation. Optionally, the support 62 can move the metallic container 30 along a longitudinal axis 2. Additionally, or alternatively, the support 62 can rotate the metallic container 30 around the longitudinal axis 2.

The metallic container 30 generally includes a container sidewall 32 and a bottom or closed end 34. In one embodiment, the closed end has an inclined wall 35 and optionally includes a dome 36 that is oriented inwardly. An opening 44 is formed opposite to the closed end 34. The metallic container 30 can have a generally straight upper edge that extends substantially parallel to the longitudinal axis 2B. A container neck curl 46 can optionally be formed at an uppermost portion of the metallic container 30. The container neck curl 46 can be folded or compressed flat against the body. The container neck may be folded two or more times to form the container neck curl 46. In one embodiment, the container neck curl 46 extends outwardly away from the longitudinal axis 2B of the metallic container 30 as generally illustrated in FIG. 2. Alternatively, the container curl can extend inwardly into the interior of the metallic container.

The metallic container 30 can be of any predetermined size or shape. In one embodiment, the container sidewall 32 is generally parallel to the longitudinal axis 2B of the metallic container. More specifically, in one embodiment, the sidewall 32 has a substantially uniform diameter and extends from the bottom or closed end 34 to the opening 44 at the upper end such that the container neck 42 has the same diameter as the container sidewall 32. Accordingly, in one embodiment, the opening 44 of the metallic container 30 can have a diameter that is approximately equal to a diameter of the sidewall 32.

Alternatively, at least a portion of the container sidewall 32 can be sloped or angled relative to the longitudinal axis. For example, the container sidewall 32 can optionally include a shoulder 40 that defines a container neck 42 with a decreased diameter.

In one embodiment, the container sidewall 32 is generally cylindrical. Optionally, a cross-sectional of the container sidewall 32 taken substantially perpendicular to the longitudinal axis 2B has a shape that is not circular. More specifically, in one embodiment, a horizontal cross-section of the container sidewall 32 can define an oval, a square, a rectangle, or another shape, such as a polygon.

Referring now to FIG. 3, after the metallic container 30 is at least partially filled with a product, the metallic end closure 4 can be positioned or seated on the metallic container 30 and extend at least partially within the container opening 44. In this manner, the container curl 46 is positioned between the outer and inner panel walls 10, 14 of the metallic end closure 4.

When the metallic end closure 4 is seated in the container opening, the central panel 18 is positioned between the container curl 46 and the container bottom 34 relative to the longitudinal axis 2. Additionally, the central panel 18 is positioned between a lowermost portion of the outer panel wall 10, such as the peripheral curl 8 of the metallic end closure 4, and the container bottom 34 relative to the longitudinal axis when the metallic end closure is seated in the container opening as generally illustrated in FIG. 3.

The peripheral curl 8 of the metallic end closure 4 is positioned between the container curl 46 and the central panel 18 relative to the longitudinal axis 2 when the metallic end closure is seated in the container opening. Moreover, the container curl 46 is positioned between the closure peripheral curl 8 and the countersink 12 when the metallic end closure is positioned in the container opening.

A capping apparatus 60 of one embodiment of the present disclosure can subsequently releasably interconnect the metallic end closure 4 to the metallic container 30. Optionally, the capping apparatus 60 includes a first tool 64. The first tool 64 is optionally configured to apply a topload to the metallic end closure to press the metallic container and the metallic end closure together. In one embodiment, the first tool 64 can contact the countersink 12 to apply the optional topload to the metallic end closure. The container neck curl 46 may press into the sealant 20 when present.

Referring now to FIGS. 3-9, a closing or joining tool 66 of the capping apparatus 60 is operable to apply a force to the metallic end closure 4 and the metallic container 30. In this manner, the joining tool 66 can change the geometry of the metallic container neck 42 and of the outer and inner panel walls 10, 14 of the metallic end closure to releasable join the metallic end closure to the metallic container. The force from the joining tool 66 can be oriented approximately perpendicular to the longitudinal axis 2. Optionally, the force may be oriented transverse to the longitudinal axis. In one embodiment, the joining tool 66 can optionally crimp or otherwise compress the inner panel wall 14 and outer panel wall 10 together and against the neck 42 of the metallic container.

In one embodiment, the joining tool 66 is configured to form at least one thread 28 in the metallic end closure 4 and the metallic container 30. In one embodiment, the thread 28 formed by the joining tool 66 extends outwardly away from the longitudinal axis 2. Alternatively, the thread 28 extends inwardly toward the longitudinal axis.

The joining tool 66 may form each thread 28 individually. Alternatively, the joining tool 66 can be configured to form two or more threads, or all of the threads, substantially simultaneously.

In one embodiment, the joining tool 66 can rotate around the longitudinal axis 2 when joining the metallic end closure to the metallic container. In another embodiment, the joining tool 66 can spiral around the longitudinal axis 2. For example, the joining tool 66 can move axially relative to the longitudinal axis 2 one or more of toward and away from the container closed end 34 while joining the metallic end closure 4 to the metallic container 30. Additionally, or alternatively, the joining tool 66 can optionally apply a force to the metallic end closure 4 to the metallic container 30 that is oriented transverse to the longitudinal axis.

Referring now to FIG. 3, the joining tool 66 can include one or more of an inner tool 68 and an outer tool 72. The inner and outer tools 68, 72 can optionally be interconnected to the first tool 64. The inner tool 68 has an outer face 69 configured to generally conform to the interior surface of the inner panel wall 14 of the metallic end closure. In one embodiment, a protrusion 70 projects outwardly from the outer face 69.

The outer tool 72 has an inner face 73 which has a geometric profile that generally corresponds to the outer panel wall 10 of the metallic end closure 4. In one embodiment, a recess 74 is formed in the inner face 73. The recess 74 generally aligns with the protrusion 70 of the inner tool 68. The protrusion 70 of the inner tool is configured to force the metallic end closure and the metallic container outwardly and into the recess 74 of the outer tool to form a thread 28.

Alternatively, in another embodiment, the recess 74 is formed in the outer face 69 of the inner tool 68. Continuing this example, the protrusion 70 is formed in the inner face 73 of the outer tool 72. In this manner, the protrusion 70 of the outer tool 72 is configured to force the metallic end closure and the metallic container inwardly and into the recess 74 of the inner tool 68 to form the thread 28.

Figure 4:
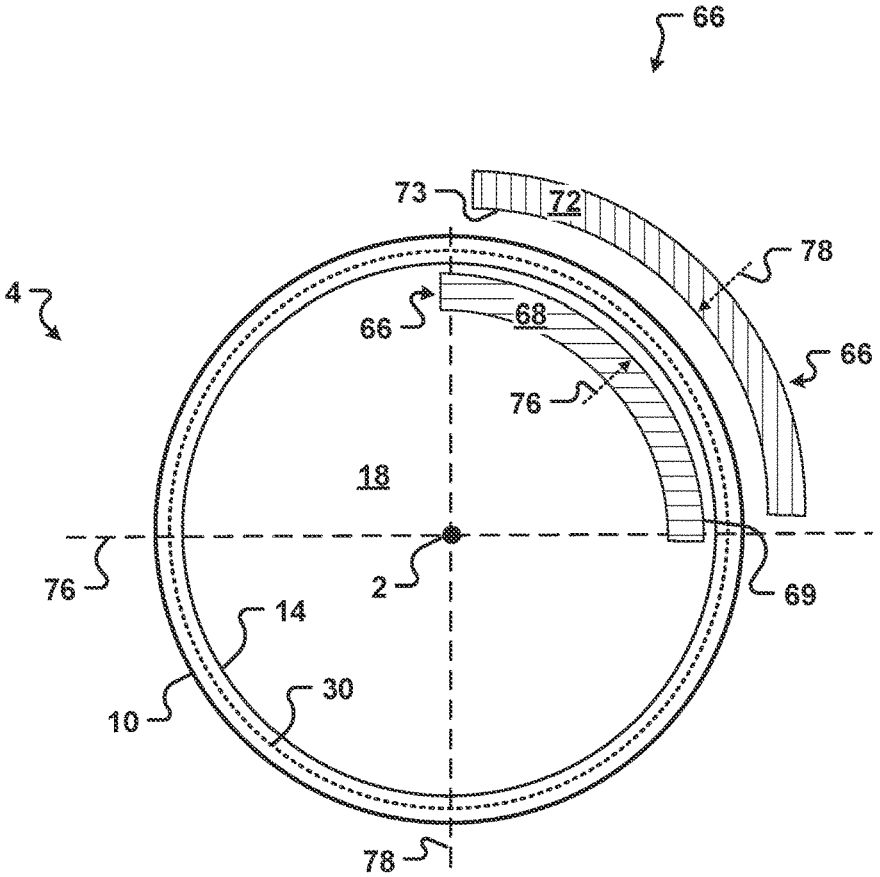
FIG. 4 is a top plan of the metallic end closure of FIG. 3 with the metallic container shown in phantom lines and showing joining tools of the capping apparatus configured to releasably interconnect the metallic end closure to the metallic container.

Referring now to FIG. 4, the outer face 69 of the inner tool 68 can have a radius of curvature that is substantially equal to the radius of curvature of the inner panel wall 14. The inner tool 68 can move outwardly away from the longitudinal axis 2 (as generally indicated by arrow 76) to apply a force to the metallic end closure 4 and the metallic container 30 to form the thread 28.

The outer tool 72 is configured to move inwardly toward the longitudinal axis 2 (as generally indicated by arrow 78) to apply a force to the metallic end closure and the metallic container when the joining tool 66 forms the thread 28. As generally illustrated in FIG. 4, the inner face 73 of the outer tool 72 can have a radius of curvature that is substantially equal to the radius of curvature of the outer panel wall 10.

Any suitable method known to one of skill in the art may be used to control the movement of the inner and outer tools. In one embodiment, movement of the inner and outer tools 68, 72 is controlled by one or more cams.

Figure 5:
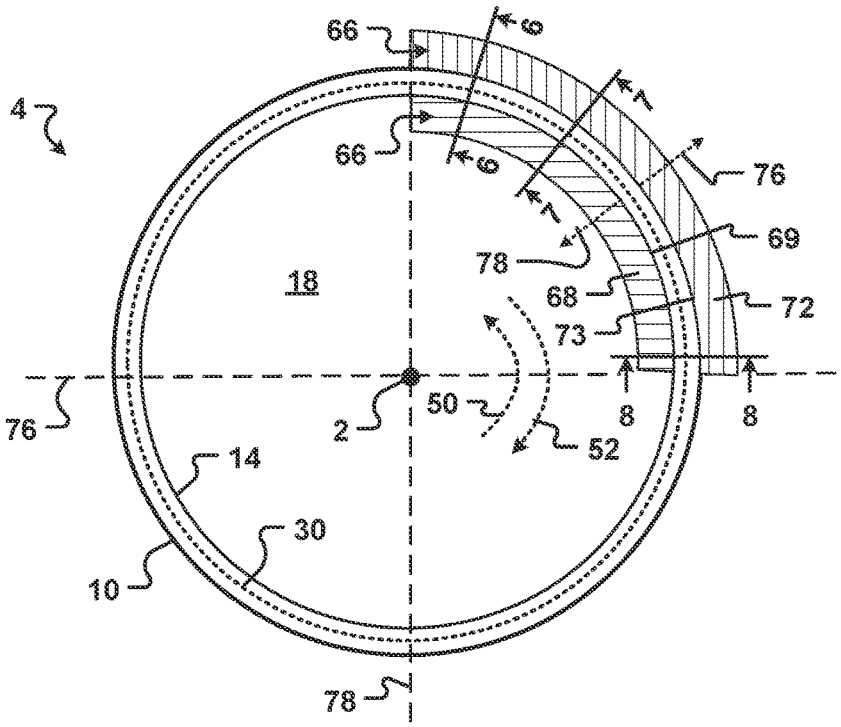
FIG. 5 is another top plan view of the metallic end closure of FIG. 4 after the joining tools have interconnected the metallic end closure to the metallic container.

Referring now to FIG. 5, after the joining tool 66 has formed the thread 28, the inner tool 68 can move inwardly and away from the inner panel wall 14 as indicated by arrow 78. Similarly, the outer tool 72 is configured to move outwardly as generally shown by arrow 76 away from the outer panel wall 10 after forming the thread.

After the metallic end closure 4 is joined to the metallic container, the metallic end closure 4 can be rotated in an opening direction 50 to open the metallic container 30. In one embodiment, the opening direction 50 is counter-clockwise around the longitudinal axis 2 in the perspective of FIG. 5. Optionally, the metallic end closure can be removed from the metallic container by rotating the metallic end closure between approximately 75° and approximately 100° in the opening direction. In one embodiment, the metallic end closure 4 can be removed from the metallic container 30 after a rotation of less than approximately 85° in the opening direction 50. Thereafter, the metallic container can subsequently be re-closed by positioning the metallic end closure 4 in the container opening and rotating the closure in a closing direction 52.

Figure 7:
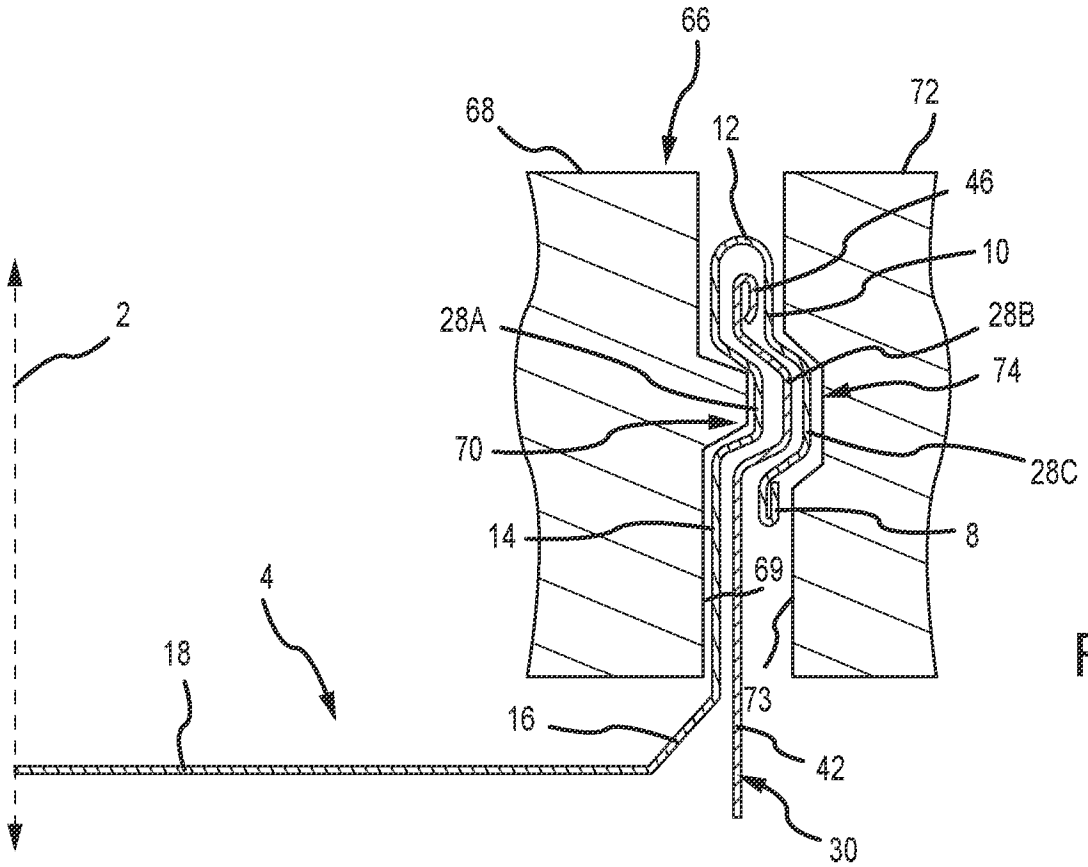
FIG. 7 is a partial cross-sectional front elevation view taken along line 7-7 of FIG. 5 and illustrating a medial portion of the thread formed by the joining tools.

Referring now to FIG. 6, a partial cross-sectional view of the inner and outer tools 68, 72 during formation of an upper portion of a thread 28 is generally provided. FIG. 7 generally illustrates the inner and outer tools 68, 72 forming a medial portion of the thread 28. The formation of a lower portion of the thread 28 is generally illustrated in FIG. 8.

Notably, in one embodiment, the inner and out tools 68, 72 extend downwardly below the peripheral curl 8 of the metallic end closure 4. Accordingly, in one embodiment, at least a portion of the thread 28 may be formed in only the inner panel wall 14 and the container neck 42 as generally illustrated in FIG. 8. More specifically, an exterior surface of a portion of the container thread 28B formed in the container neck 42 can optionally extend downwardly below the outer panel wall 10 and peripheral curl 8 of the metallic end closure 4 as generally illustrated in FIG. 8. In contrast, in the medial portion of the thread 28, the exterior surface of the container thread 28B formed in the container neck 42 is covered by an outer portion of the closure thread 28C formed in the outer panel wall 10 as generally illustrated in FIG. 7. Accordingly, in one embodiment, the container thread portion 28B has a helical length that is greater than a helical length of the outer closure thread portion 28C.

Extending the container thread 28B of the container neck 42 beyond the lowermost portion of the outer closure thread portion 28C of the outer panel wall 10 is facilitated by spacing the central panel 18 below the closure peripheral curl 8 as described in conjunction with FIG. 1. By extending the container thread 28B beyond the lowermost portion of the outer closure thread portion 28C, the metallic end closure 4 can be removed from the metallic container 30 without interference from an unthreaded portion of the outer panel wall 10. More specifically, as generally illustrated in FIG. 7, the closure peripheral curl 8 can have an interior diameter that is less than an exterior diameter of the container thread 28B of the container neck 42. Accordingly, if the lowermost portion of the thread 28 is above the closure peripheral curl 8 as shown in FIG. 7, the peripheral curl 8 may contact the lowermost portion of container thread 28B which may prevent removal of the metallic closure 4 from the metallic container 30.

Figure 8:
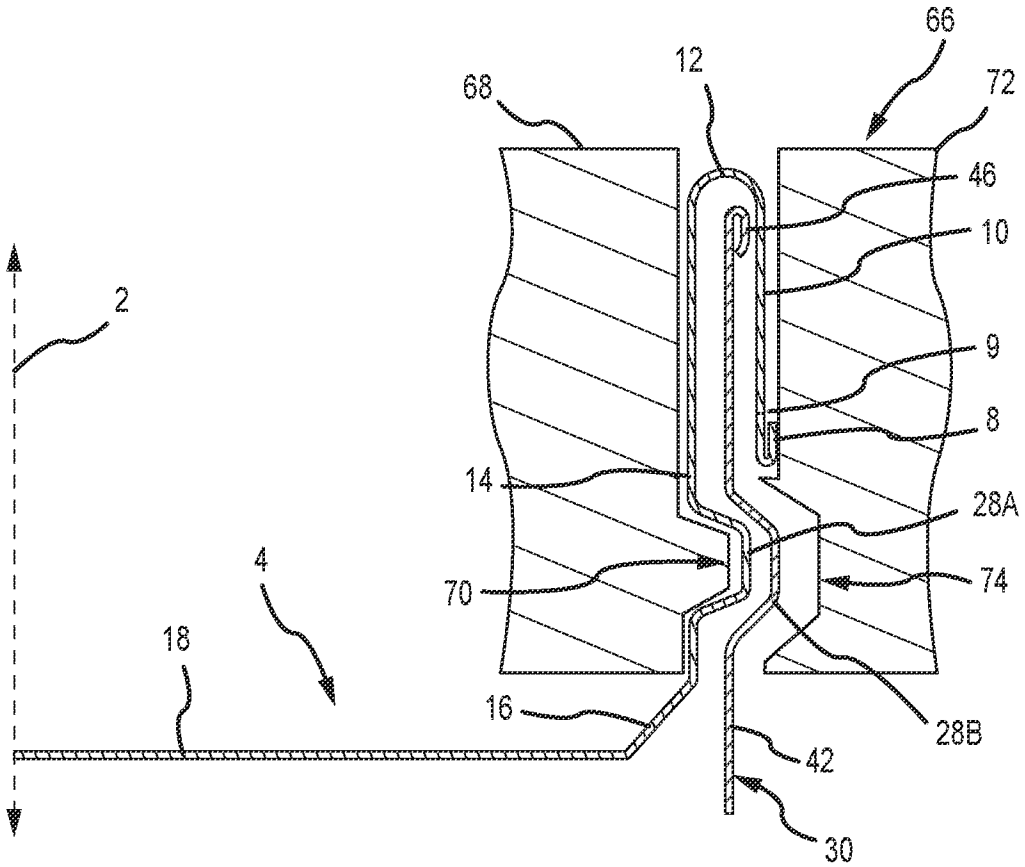
FIG. 8 is another partial cross-sectional front elevation view taken along line 8-8 of FIG. 5 which illustrates the joining tools forming a lower portion of the thread.

As is generally illustrated in FIGS. 6-8, the projection 70 of the inner tool 68 of one embodiment can extend from a position proximate to an upper end of the outer face 69 to a position proximate to the lower end of the outer face. The recess 74 of the outer tool 72 of one embodiment has a corresponding geometric profile extending from a position proximate to an upper end of the inner face 73 to a position proximate to the lower end of the inner face.

As generally illustrated in FIGS. 6-8, each thread 28 includes an inner closure thread portion 28A and an outer closure thread portion 28C that engage a container thread portion 28B. The closure thread portions 28A, 28C and the container thread portion 28B are formed substantially simultaneously by the joining tool 66. As generally shown in FIG. 8, the central panel 18 of the metallic end closure is positioned between a lowermost portion of the thread 28 and the closed bottom end of the container body when the metallic end closure is sealed in the container opening.

Figure 9:
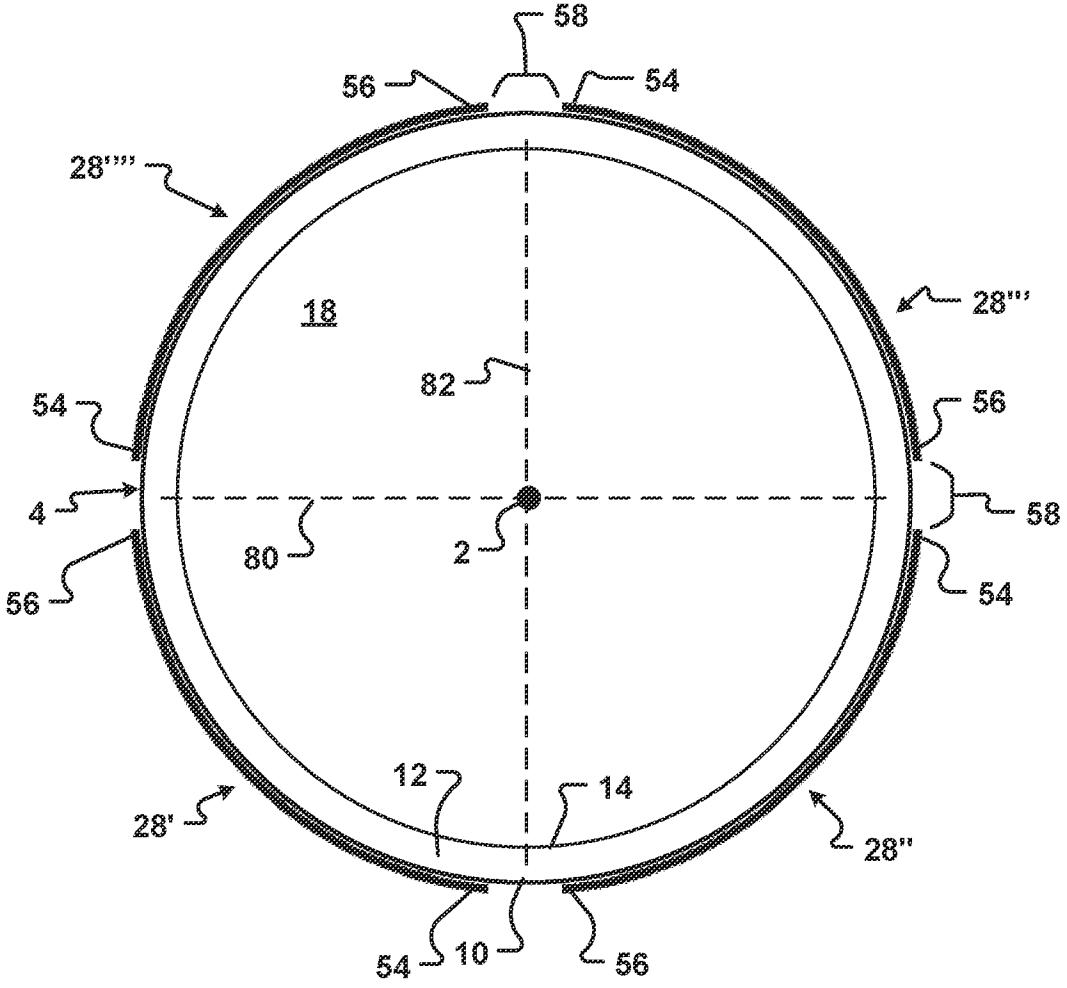
FIG. 9 is a top plan view of a metallic end closure illustrating threads spaced around an exterior of the metallic end closure according to one embodiment of the present disclosure.

Referring now to FIG. 9, the joining tool 66 may optionally form two or more threads, for example two to ten threads. In one embodiment, the joining tool 66 is configured to form four threads 28', 28", 28'" and 28"" that are substantially equally spaced around the circumference of the metallic end closure 4 and the metallic container.

Each thread 28 may be a helical thread that wraps at least partially around a circumference of the metallic end closure 4. In one embodiment, a thread 28 can extend between approximately 45° to approximately 540° around the circumference. Optionally, the threads can extend up to approximately one-fourth, or up to one-half of the closure circumference. In one embodiment, each thread extends from approximately ⅛ to approximately ⅝ around the closure circumference.

The threads 28 can be multi-lead threads. Additionally, or alternatively, in one embodiment the threads 28 are spaced such that a first thread 28' does not overlap a second adjacent thread 28". For example, an upper beginning 54 of a first thread 28' can be spaced around the closure circumference from a lower end 56 of a second thread 28" which is adjacent to the first thread 28' as generally illustrated in FIG. 9. Accordingly, in one embodiment, the outer and inner panel walls 10, 14 and the container neck 42 can be substantially parallel to the longitudinal axis (or unbent) between two adjacent threads 28', 28". Moreover, in one embodiment, a beginning 54 of a thread 28 is separated by an arc 58 of a predetermined length from an end 56 of a second thread 28.

Figure 10:
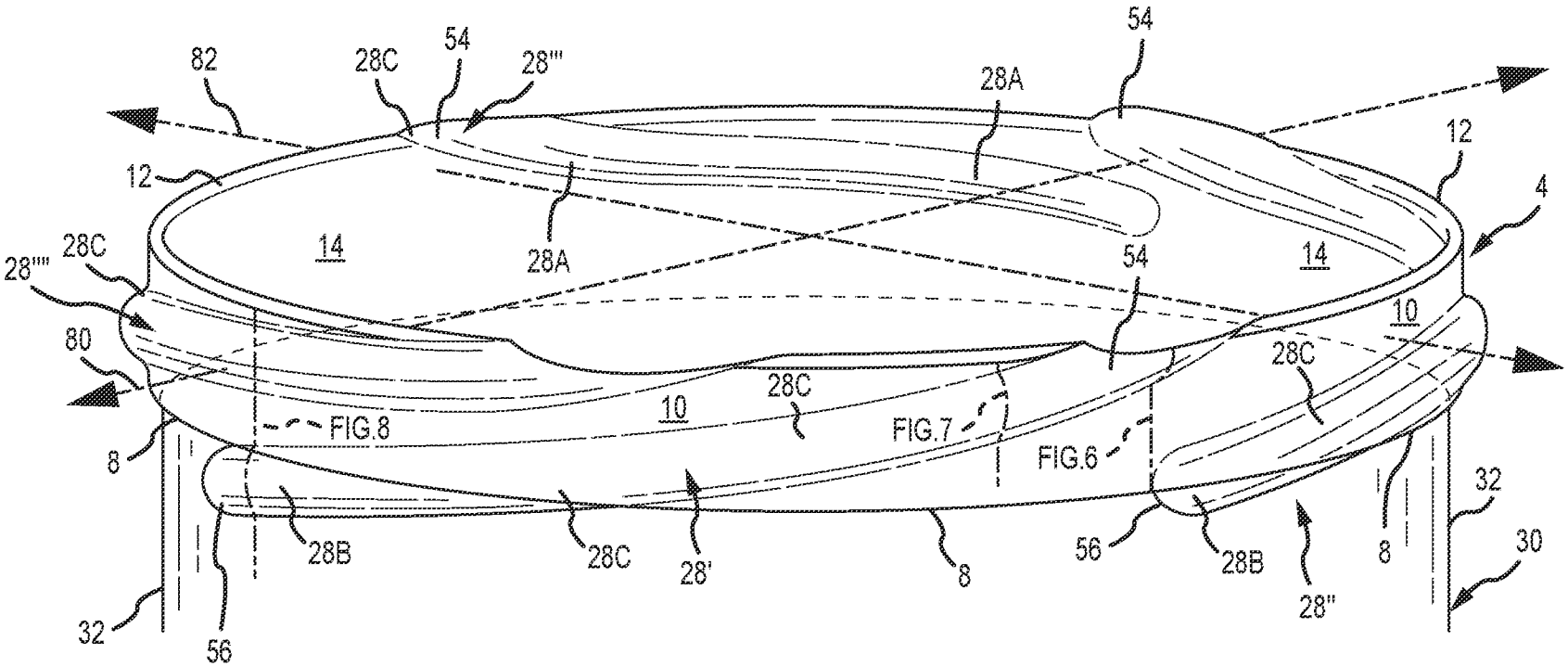
FIG. 10 is a partial front perspective view illustrating threads formed in the metallic end closure and the metallic container.
Figure 11:
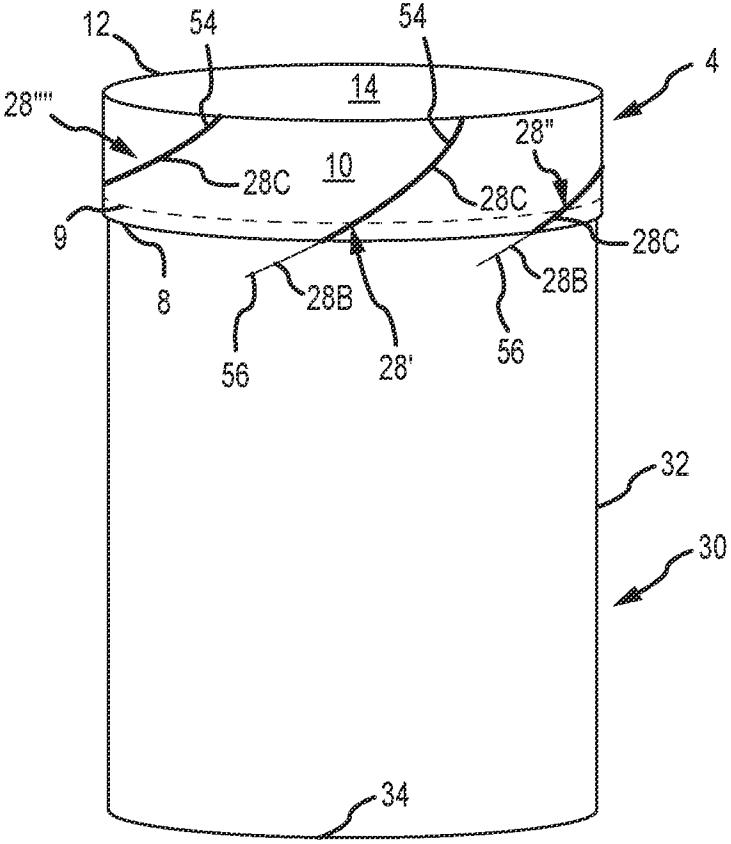
FIG. 11 is a front perspective view of the metallic container of FIG. 10 with the metallic end closure sealed to the metallic container.

Referring now to FIGS. 10-11, a metallic container 30 according to one embodiment of the present disclosure is generally illustrated after being sealed with a metallic end closure 4. Threads 28 have been formed in the metallic end closure 4 and the metallic container 30. The threads 28 generally extend around up to approximately 25% of the circumference of the metallic container 30. More specifically, each thread can extend up to approximately 25% of the circumference.

The threads 28 include an upper portion or thread beginning 54 that extends to the countersink 12 at the uppermost portion of the metallic end closure 4. A lowermost portion or thread end 56 of the threads 28 extends downward below the closure peripheral curl 8 at the lowermost portion of the outer panel wall 10. Below the peripheral curl 8, the lowermost portion of the container thread 28B is not covered by the outer panel wall 10.

Optionally, the joining tool 66 of the capping apparatus 60 can form a plurality of threads 28 in the metallic container and the metallic end closure. For example, the joining tool can be configured to form four separate threads 28', 28", 28''', and 28'''' in the metallic container 30 as generally illustrated in FIGS. 9-10.

Figure 12:
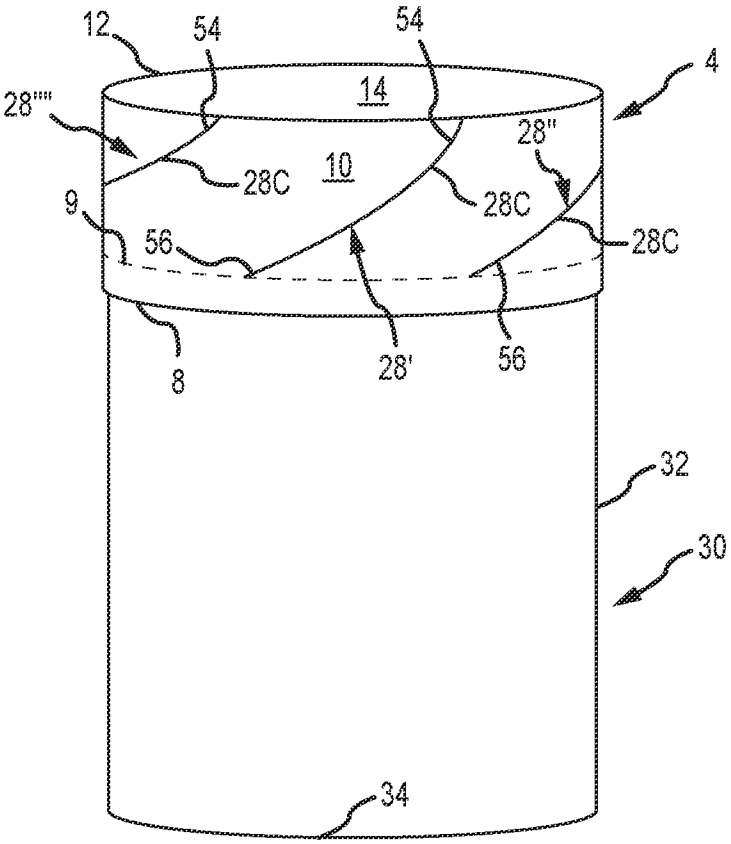
FIG. 12 is another front perspective view illustrating a thread of another embodiment of the present disclosure that extends from an uppermost portion of a metallic end closure and in which the thread ends before reaching a lowermost portion of an outer panel wall of the metallic end closure.

Referring now to FIG. 12, in one embodiment the joining tool 66 is configured to form a thread 28 in the metallic container 30 and the metallic end closure 4 that does not extend downwardly lower than the peripheral curl 8. More specifically, the joining tool 66 can be configured to form only the upper portion and the medial portion of the thread 28 as generally illustrated in FIGS. 6-7. It follows that in one embodiment of the present disclosure, a lowermost portion of a thread end 56 is positioned between a lowermost portion of the closure outer panel wall 10 and the closure countersink 12.

In one embodiment, a score 9 extends around a circumference of the outer panel wall 10 and through the thread end 56. In another embodiment, the score 9 is spaced above the thread end. More specifically, in one embodiment, the score 9 is positioned between thread end 56 and the closure countersink 12. Accordingly, the score may be positioned no lower than the thread end 56. In this manner, for embodiments of the end closure 4 which include a score 9 to form a pilfer or tamper band, the outer closure thread portion 28C will extend through the score 9.

When the metallic end closure 4 is rotated in the opening direction 52, the peripheral curl 8 will press against a lower surface of the container thread 28B which can sever the optional score 9 (illustrated in FIG. 12) between the peripheral curl 8 and the outer panel wall 10. The peripheral curl 8 will then separate from the metallic end closure 4 and be retained on the container neck 42. In this manner, the peripheral curl 8 can define a tamper indicator to visibly indicate that the metallic end closure has been rotated at least partially in the opening direction.

To provide additional background, context, and to further satisfy the written description requirements of 35 U.S.C. § 112, the following references related to printing methods and apparatus are incorporated by reference herein in their entireties: U.S. Pat. Nos. 4,054,229, 5,704,240, 5,806,707, 7,905,130, 7,942,028, 9,265,287, 9,617,043, 9,821,926, 9,868,564, 10,040,593, U.S. Pat. App. Pub. 2014/0116979, U.S. Pat. App. Pub. 2015/0108132, U.S. Pat. App. Pub. 2018/0044155, U.S. Pat. App. Pub. 2018/0134460 and PCT Pub. WO 2018/031617 each of which are each incorporated herein by reference in their entireties.

While various embodiments of the system have been described in detail, it is apparent that modifications and alterations of those embodiments will occur to those skilled in the art. It is to be expressly understood that such modifications and alterations are within the scope and spirit of the present disclosure. Further, it is to be understood that the phraseology and terminology used herein is for the purposes of description and should not be regarded as limiting. The use of "including," "comprising," or "having" and variations thereof herein are meant to encompass the items listed thereafter and equivalents thereof, as well as, additional items.

What is claimed is:

1. An apparatus to seal a metallic container with a metallic end closure, comprising:

a first tool to receive the metallic container, the metallic container comprising a closed bottom end, a container sidewall extending upwardly from the closed bottom end, and a container curl extending from an upper end of the container sidewall to define an opening, wherein the metallic end closure is positioned in the opening of the metallic container and includes a central panel, an inner panel wall extending upwardly from the central panel, a countersink extending outwardly from the inner panel wall and forming an uppermost portion of the metallic end closure, and an outer panel wall extending downwardly from the countersink, the outer panel wall being oriented approximately parallel to the container sidewall; and a joining tool configured to apply a compressive force to the metallic container and the metallic end closure to seal the metallic end closure to the metallic container, wherein the joining tool is configured to form a thread by bending portions of the inner and outer panel walls of the metallic end closure and the container sidewall outwardly or inwardly such that the metallic end closure is releasably connected to the metallic container, wherein the joining tool comprises:

an inner tool with an outer face having a convex shape that is approximately congruent to a concave segment of the inner panel wall of the metallic end closure; and an outer tool with an inner face having a concave shape that is approximately congruent to a convex segment of the outer panel wall of the metallic end closure.

2. The apparatus of claim 1, wherein the joining tool is adapted to compress the container sidewall between the inner and outer panel walls of the metallic end closure to form the thread.

3. The apparatus of claim 1, wherein the joining tool is configured to form the thread with a helical length that extends between approximately 45° and approximately 120° of a circumference of the metallic end closure.

4. The apparatus of claim 3, wherein the joining tool is adapted to form the thread from the countersink of the metallic end closure and downward past a lowermost portion of the outer panel wall.

5. The apparatus of claim 4, wherein between the countersink and the lowermost portion of the outer panel wall, the thread comprises a container thread portion positioned between an inner closure thread portion on the inner panel wall and an outer closure thread portion on the outer panel wall.

6. The apparatus of claim 5, wherein below the lowermost portion of the outer panel wall, the thread comprises the inner closure thread portion on the inner panel wall and the container thread portion which is not covered by the outer panel wall.

7. The apparatus of claim 1, wherein before the joining tool forms the thread the outer panel wall of the metallic end closure and the container sidewall are approximately parallel to a longitudinal axis of the metallic container.

8. The apparatus of claim 1, further comprising a second tool to apply a top-load to the countersink to press the metallic end closure against the container curl.

9. The apparatus of claim 1, wherein the inner tool and the outer tool are configured to move toward each other such that a protrusion on the outer face of the inner tool interlocks with a recess on the inner face of the outer tool to compress the container sidewall between the inner panel wall and the outer panel wall to form the thread.

10. The apparatus of claim 1, wherein the joining tool is adapted to form the thread such that the thread extends from the countersink of the metallic end closure to a point above a lowermost portion of the outer panel wall.

11. The apparatus of claim 10, wherein the metallic end closure includes a peripheral curl releasably interconnected to the lowermost portion of the outer panel wall by a score or a perforation that is intersected by the thread.

12. A method of sealing a metallic container with a selectively removable metallic end closure, comprising:

positioning the metallic end closure in an opening of the metallic container, wherein the metallic container includes a closed bottom end, a container sidewall extending upwardly from the closed bottom end, and a container curl extending from an upper end of the container sidewall to define the opening, and wherein the metallic end closure has a central panel, an inner panel wall extending upwardly from the central panel, a countersink at an upper end of the inner panel wall and extending outwardly from the inner panel wall, and an outer panel wall extending downwardly from the countersink, wherein the outer panel wall is oriented approximately parallel to the container sidewall; and applying a compressive force to the metallic container and the metallic end closure with a joining tool to seal the metallic end closure to the metallic container, wherein the joining tool bends the inner and outer panel walls of the metallic end closure and the container sidewall to form a thread, and wherein the metallic end closure is releasably connected to the metallic container, wherein the applying the compressive force comprises:

moving an inner tool of the joining tool outwardly against the inner panel wall, the inner tool having an outer face with a convex shape that is approximately congruent to a concave segment of the inner panel wall of the metallic end closure, wherein a protrusion projects outwardly from the outer face; and moving an outer tool of the joining tool inwardly against the outer panel wall, the outer tool having an inner face with a concave shape that is approximately congruent to a convex segment of the outer panel wall of the metallic end closure, wherein a recess extends inwardly from the inner face and is adapted to interlock with the protrusion of the inner tool.

13. An apparatus to seal a metallic container with a metallic end closure, comprising:

a first tool to receive the metallic container, the metallic container including a closed bottom end, a container sidewall extending upwardly from the closed bottom end, and a container curl extending from an upper end of the container sidewall to define an opening, wherein the metallic end closure is positioned in the opening of the metallic container and includes a central panel, an inner panel wall extending upwardly from the central panel, a countersink extending outwardly from the inner panel wall and forming an uppermost portion of the metallic end closure, and an outer panel wall extending downwardly from the countersink, the outer panel wall being oriented approximately parallel to the container sidewall; and a joining tool to apply a compressive force to the metallic container and the metallic end closure to seal the metallic end closure to the metallic container, the joining tool being configured to form a thread by bending a portion of the inner and outer panel walls of the metallic end closure and the container sidewall to releasably connect the metallic end closure to the metallic container, wherein the joining tool is adapted to compress the container sidewall between the inner and outer panel walls of the metallic end closure to form the thread, wherein the joining tool comprises:

an inner tool with an outer face having a convex shape that is approximately congruent to a concave segment of the inner panel wall of the metallic end closure; and an outer tool with an inner face having a concave shape that is approximately congruent to a convex segment of the outer panel wall of the metallic end closure.

14. The apparatus of claim 13, wherein the joining tool is configured to form the thread such that, between the countersink and the lowermost portion of the outer panel wall, the thread comprises a container thread portion positioned between an inner closure thread portion on the inner panel wall and an outer closure thread portion on the outer panel wall.

15. The apparatus of claim 13, wherein a protrusion projects outwardly from the outer face of the inner tool and a recess extends inwardly from inner face of the outer tool, wherein the recess is adapted to interlock with the protrusion of the inner tool to form the thread, and wherein the inner tool and the outer tool are configured to move toward each other to compress the container sidewall between the inner panel wall and the outer panel wall.

16. The apparatus of claim 13, wherein the joining tool is adapted to form the thread such that the thread extends from the countersink of the metallic end closure to a point above a lowermost portion of the outer panel wall.

17. The apparatus of claim 13, wherein the joining tool is adapted to form the thread such that the thread extends across a score or a perforation of the metallic end closure, the score or perforation adapted to releasably interconnect a peripheral curl of the metallic end closure to the lowermost portion of the outer panel wall.

* * * * *